US007174828B2

(12) United States Patent
Davies et al.

(10) Patent No.: US 7,174,828 B2
(45) Date of Patent: Feb. 13, 2007

(54) LINEAR ACTUATOR

(75) Inventors: Stephen Harlow Davies, Shifnal (GB); Mark Anthony Guy, Codsall (GB); Michael Paul Somerfield, Stoke-on-Trent (GB); David Roy Tucker, Craven Arms (GB)

(73) Assignee: Goodrich Actuation Systems Limited (GB)

( * ) Notice: Subject to any disclaimer, the term of this patent is extended or adjusted under 35 U.S.C. 154(b) by 0 days.

(21) Appl. No.: 11/142,112

(22) Filed: Jun. 1, 2005

(65) Prior Publication Data

US 2006/0054016 A1 Mar. 16, 2006

(30) Foreign Application Priority Data

Jun. 2, 2004 (GB) ..... 0412255.2
Jun. 29, 2004 (GB) ..... 0414458.0
Dec. 17, 2004 (GB) ..... 0427687.9

(51) Int. Cl.
*F01B 3/00* (2006.01)
*F15B 15/14* (2006.01)

(52) U.S. Cl. ..... 92/115; 92/109

(58) Field of Classification Search ..... 92/109, 92/113, 114, 115
See application file for complete search history.

(56) References Cited

U.S. PATENT DOCUMENTS

| | | | |
|---|---|---|---|
| 2,193,736 | A | 3/1940 | Onions |
| 2,932,281 | A | 4/1960 | Moskowitz |
| 3,621,763 | A | 11/1971 | Geyer |
| 3,986,438 | A | 10/1976 | Wittren |
| 5,331,884 | A | 7/1994 | Ando |

FOREIGN PATENT DOCUMENTS

| | | | |
|---|---|---|---|
| DE | 4116399 | | 11/1992 |
| DE | 4116399 | A1 * | 11/1992 |
| FR | 2024747 | | 9/1970 |
| JP | 56073206 | | 6/1981 |
| JP | 58113611 | | 7/1983 |
| JP | 58113611 | A * | 7/1983 |

* cited by examiner

*Primary Examiner*—Thomas E. Lazo
(74) *Attorney, Agent, or Firm*—Andrus, Sceales, Starke & Sawall, LLP

(57) ABSTRACT

A linear hydraulic actuator comprises a hollow main piston axially moveable in an elongate cylinder under the influence of hydraulic pressure, the main piston defining a bore within which a seal member is provided, the seal member forming a sliding seal with the bore of the main piston.

15 Claims, 7 Drawing Sheets

LINEAR ACTUATOR

CROSS-REFERENCE TO RELATED APPLICATIONS

This application claims priority of Great Britain Application No. GB 0412255.2 filed Jun. 2, 2004, Great Britain Application No. GB 0414458.0 filed Jun. 29, 2004, and Great Britain Application No. GB 0427687.9 filed Dec. 17, 2004.

The present invention relates to a linear hydraulic actuator.

Linear hydraulic actuators are used in a wide range of mechanical applications. They generally comprise a piston that is axially moveable under hydraulic pressure within a cylinder. In many applications the piston is connected to a shaft which extends axially through a sealed end wall of the cylinder.

One example of an application of a linear hydraulic actuator is on aircraft for actuation of thrust reversers. The exact nature of the engine thrust reverser system is not of importance to an understanding of the present invention. It will be recognised that gas turbine engine thrust reverser systems include movable elements, usually in the form of cowls or doors, which when deployed reverse the engine thrust to assist in deceleration of the aircraft. For convenience, throughout the remainder of this specification, the movable elements will be referred to as thrust reverser cowls. During normal operation a thrust reverser system will only be actuated when the aircraft is decelerating on the runway, and the gas turbine engine is operative. It is known that in thrust reverser systems, the initial movement of the thrust reverser cowls from their rest position, towards their deployed position is resisted by the air/gas flow around/through the engine, while at a later stage in the deployment the air/gas flow may actually assist the deployment movement of the cowls.

Linear hydraulic actuators for use in aircraft engine thrust reversers are designed to be of high strength and, as far as possible, of light weight. It is known to provide the actuator with a hollow piston assembly comprising a piston head and hollow piston rod and to accommodate components of an actuator synchronisation mechanism within the hollow bore of the piston assembly.

A hollow piston assembly of the above type is typically located within an hydraulic cylinder such that separate hydraulic chambers are formed on either side of the piston head. The piston rod transmits movement of the piston assembly to an external component to be moved by the actuator. As the piston rod extends from one face of the piston head the piston head presents different cross-sectional areas in the respective chambers to either side of the piston head such that when, in use, a high pressure fluid supply is connected to both hydraulic chambers a net force determined by the difference in piston areas exposed to said high pressure fluid, will be developed to displace the piston assembly within the cylinder.

The volume of pressurised fluid required to extend an hydraulic actuator of the above hollow piston assembly design may be reduced by connecting the two hydraulic chambers together, such that fluid displaced from one chamber can flow into the other chamber as the piston moves due to the force developed as a result of the different cross-sectional areas of the piston exposed to the pressurised fluid in the respective chambers. The volume of pressurised fluid required to be supplied from a high pressure fluid pump is thus equal to the difference in cross-sectional areas of the piston multiplied by the linear distance moved by the piston within the hydraulic cylinder. The rate of flow of fluid, which determines the size of the associated high pressure fluid pump, is dependent on the speed at which the piston is displaced.

According to the present invention there is provided a linear hydraulic actuator comprising a hollow piston axially moveable in an elongate cylinder under the influence of hydraulic pressure, the piston defining a bore within which a seal member is provided, the seal member forming a sliding seal between the cylinder and the bore of the piston.

The seal member may be attached to an opposing end of the cylinder by an axially extending stem.

The advantages of the actuator of the present invention are apparent from a consideration of its operation. With the piston in a retracted position at one end of its stroke, when pressurised hydraulic fluid is introduced to the cylinder, the piston moves so that the bore slides over the seal member. This means that as the tubular piston moves, the space inside the bore beyond the seal member is no longer filled with pressurised hydraulic fluid. Consequently, the volume of pressurised hydraulic fluid required for actuation is substantially reduced when compared with a known tubular piston design, and, for a given hydraulic system, the time required for actuation is reduced. As a further consequence, the diameter of the piston can be increased to meet the demands of piston strength without any significant increase in the volume of hydraulic fluid required to actuate the piston.

The cylinder may be further provided with a synchronisation mechanism for synchronising movement of the piston with movement of one or more pistons of one or more actuators coupled to the synchronisation mechanism.

The synchronisation mechanism may comprise a rotatable tube mounted axially within the cylinder and extending into the bore of the tubular piston, wherein the rotatable member has a thread that engages a corresponding thread on the bore of the tubular piston such that movement of the piston causes rotation of the tube.

It is an advantage that the use of a tubular piston together with a rotatable tube synchronisation mechanism can be deployed without any detrimental increase in the volume of hydraulic fluid required to actuate the piston.

The difference in piston cross-sectional areas provides a predetermined driving force to the piston at the operating pressure of the hydraulic system and is sized to provide a force in excess of that anticipated to be required in normal operation of the component to which the linear hydraulic actuator is attached in use. As, in most circumstances and over a significant length of the actuator stroke, a far lower force is required than is available the actuator consumes a greater volume of pressurised hydraulic fluid than necessary, resulting in a requirement for a larger capacity pump than would otherwise be required.

As the actuator is operated by the supply of pressurised hydraulic fluid only to an annular area of the piston assembly, the volume and flow rate of high pressure hydraulic fluid which is needed to operate the actuator is reduced, and a pump of correspondingly reduced capacity can be utilised.

Although ideal for many applications, such an arrangement suffers the disadvantage, particularly notable in an aircraft engine thrust reverser environment, that for a constant operating pressure, it generates the same output force throughout the whole of its operating stroke. In many aircraft thrust reverser environments the initial load which the actuator must overcome to deploy the thrust reverser is high, but after deployment commences the load which the actuator must overcome is reduced dramatically as air flow over the thrust reverser assembly aids deployment of the thrust reverser. It follows therefore that the actuator will be designed to produce sufficient force to overcome the initial deployment loads, and thus may be oversized for the remainder of the operating stroke of the actuator.

Rather than being connected to the opposing end of the cylinder by a stem, the seal member may comprise a supplementary piston slidably received within said main piston and movable longitudinally relative to said cylinder between a rest position and a limit position, said supplementary piston and said main piston including respective abutment surfaces which co-act when both the main piston and the supplementary piston are in their respective rest positions and hydraulic pressure is applied to said supplementary piston to move it from its rest position towards its limit position, said abutment of said surfaces of said supplementary piston and said main piston being such that during movement of the supplementary piston from its rest position to its limit position said supplementary piston assists the main piston in its movement from its rest position towards its actuated position, whereafter, when said supplementary piston is arrested at its limit position said main piston can continue to move relative to said cylinder towards its actuated position sliding relative to said supplementary piston.

Such an arrangement is advantageous in that it permits the generation of an increased actuation force during the initial movement of the actuator from a rest position towards a deployed position.

Preferably said supplementary piston is slidably supported on an elongate element axially fixed with respect to said cylinder, and said element and said supplementary piston including an abutment surface defining said limit position of said supplementary piston.

Conveniently said element and said supplementary piston include an abutment surface defining said rest position of said supplementary piston.

Desirably said elongate element is hollow, and provides a drain path whereby hydraulic fluid entering the elongate element in use can drain back to a low pressure side of an associated hydraulic system.

Preferably the co-operation of said main piston with said cylinder defines, within said cylinder, first and second chambers on opposite sides respectively of said main piston, said main piston exposing a larger surface area to said first chamber than to said second chamber so that application of the same hydraulic pressure to both chambers urges the main piston to move in a direction relative to said cylinder to reduce the volume of said second chamber.

It is recognised that use of such an additional piston in the actuator cannot accommodate an increased load which the actuator could unexpectedly be called upon to overcome at a point in the operating stroke of the actuator beyond the stroke of the additional piston, and it is another object of the present invention to provide an actuator in which the volume of high pressure hydraulic fluid needed to operate the actuator is minimised while at the same time providing the facility to generate higher output forces at any point in the stroke of the actuator should the actuator be called upon to do so.

A known method of providing increased actuation force is to increase the hydraulic pressure applied to the actuator. However, where an increase in available hydraulic pressure is not possible then it has been proposed to increase the piston diameter and thus the effective piston area of the piston and cylinder arrangement of the hydraulically operated linear actuator in order to provide the necessary initial force. Such a solution of course produces an actuator which has increased force throughout the whole of the range of movement of the actuator. Moreover, increasing the piston diameter involves an increase in the size, and thus the mass of the actuator and consequent upon this there is needed an increase in the volume and/or flow rate of hydraulic fluid which must be supplied to the actuator to perform an actuation stroke within the required operating time. Usually an increase in the volume of hydraulic fluid required involves an increase in the mass of the associated hydraulic fluid pump, and such mass increases are generally not acceptable in aircraft systems.

U.S. Pat. No. 5,941,158 discloses an hydraulic linear actuator in which an increase in the force generated during initial actuation is achieved without the disadvantages mentioned above, through the use of a supplementary piston which augments the force provided by the main piston of the actuator during initial movement of the actuator from a rest position towards a deployed position. It can be seen that the actuator of U.S. Pat. No. 5,941,158 utilises a supplementary piston of annular form sliding in an end closure member of the cylinder and the main piston of the actuator, which carries most of the loads and vibration of operation of the associated thrust reverser system in use, sliding in the supplementary piston. The sliding interfaces of the main and supplementary pistons and the end closure member are sealed by concentric seals and it is found that it is difficult, given the inherent compliance necessary in the seals, to maintain accurate control over the tolerances in such an assembly with the attendant risk of leakage of hydraulic fluid past the seals and loss of the fluid externally of the actuator. It is a further object of the present invention to provide an hydraulically operated linear actuator in which an increased operating force is available during initial deployment movement of the actuator, and wherein the actuator construction is more suited to prolonged operation at high operating pressures.

The seal member and bore of the main piston may together define a closed chamber, and, a fluid flow path may be provided between said inner, closed, end chamber of said hollow piston assembly and a hydraulic fluid supply line, said fluid flow path including a flow restrictor whereby the rate at which hydraulic fluid can enter said inner, closed, end chamber of said hollow piston assembly from said supply line is less than the rate at which the volume of said inner, closed end chamber increases as said piston assembly is moved during normal operation.

Preferably a non-return valve is associated with said fluid flow path so that during movement of said piston assembly relative to said cylinder to discharge hydraulic fluid from the interior of the piston assembly through said path, said valve opens so that fluid discharged from the interior of said hollow piston assembly is not required to flow through said restrictor.

Desirably said seal member is carried by a rod disposed coaxially within said hollow piston assembly and secured to the cylinder.

Conveniently said fluid flow path includes a passage extending through said rod.

Desirably said non-return valve is carried by said rod.

Conveniently said passage through said rod interconnects said pressure chamber and said end chamber.

Preferably the linear hydraulic actuator includes a change-over valve operable in a first position to connect said supply line to a supply of hydraulic fluid under pressure, and operable in a second position to connect said supply line to low pressure to permit discharge of hydraulic fluid from the actuator.

Conveniently said restrictor and said non-return valve are connected hydraulically in parallel with one another.

Conveniently said restrictor and said non-return valve are defined by a common component in the form of a non-return valve which leaks in its closed position to permit a restricted flow of hydraulic fluid from said supply line to said end chamber.

Desirably said hollow piston assembly includes a piston rod protruding from one axial end of said cylinder for connection to a component to be actuated by the actuator.

The invention will further be described, by way of example only, with reference to the accompanying drawings, in which.

Figure 5:
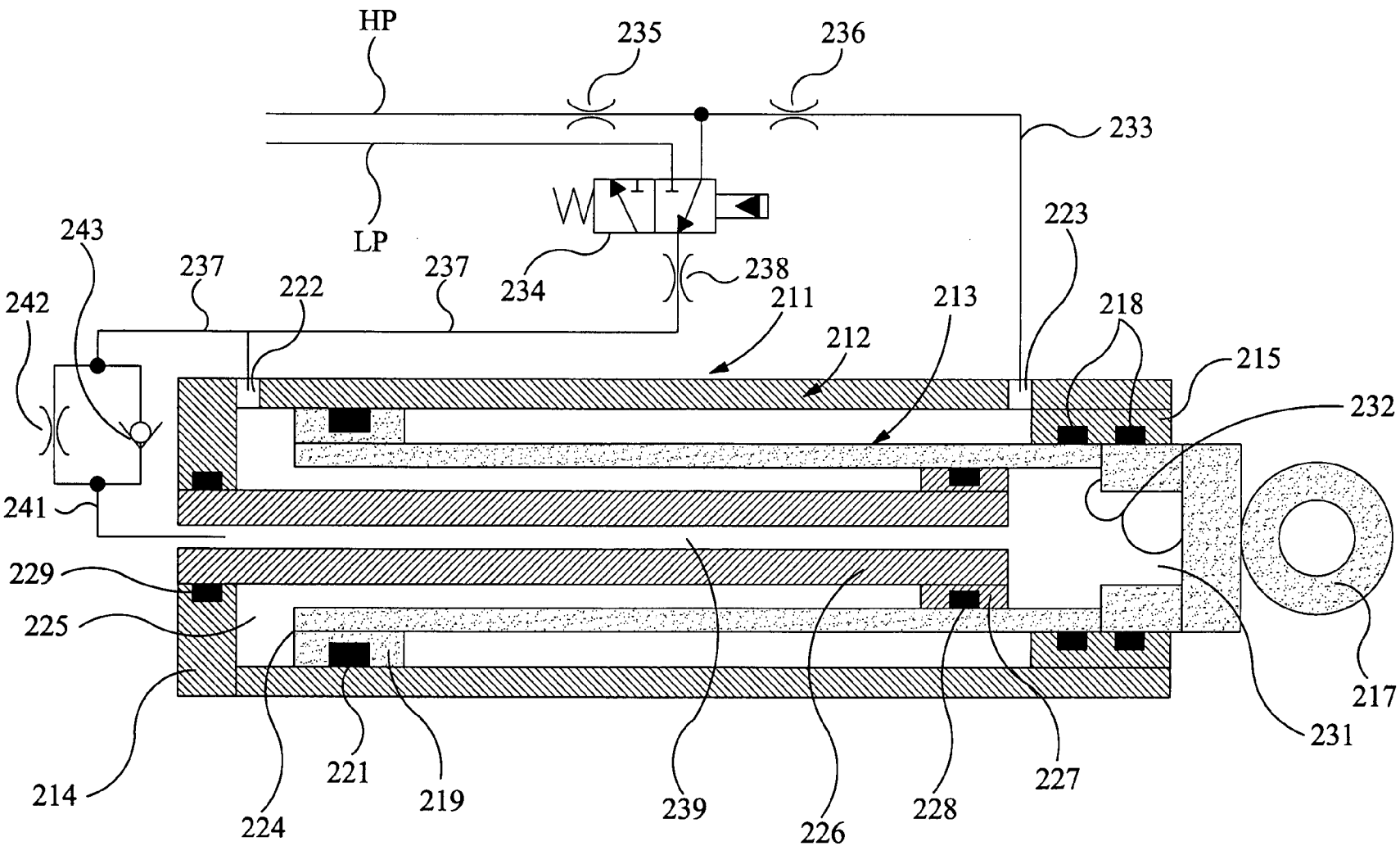
Figure 6:
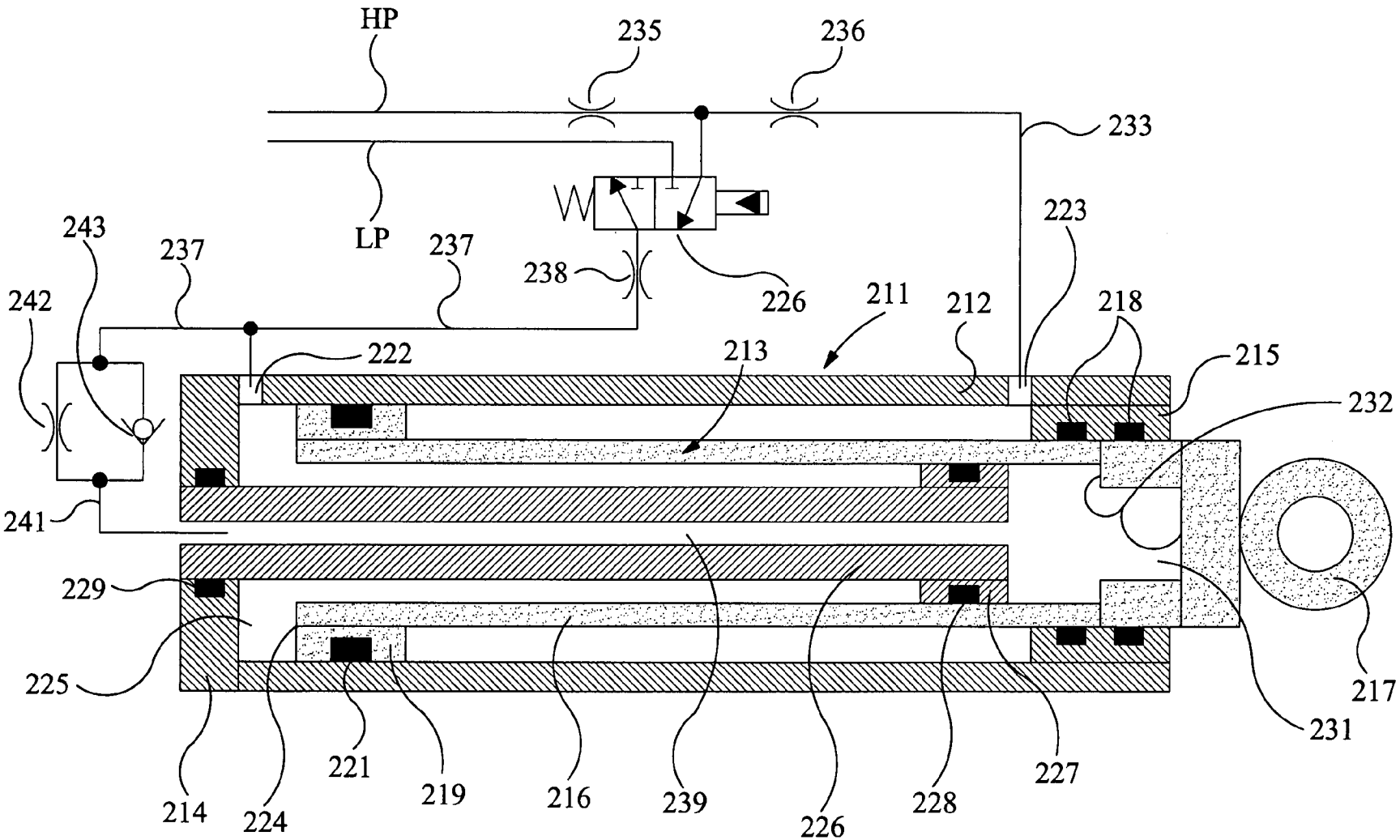
Figure 7:
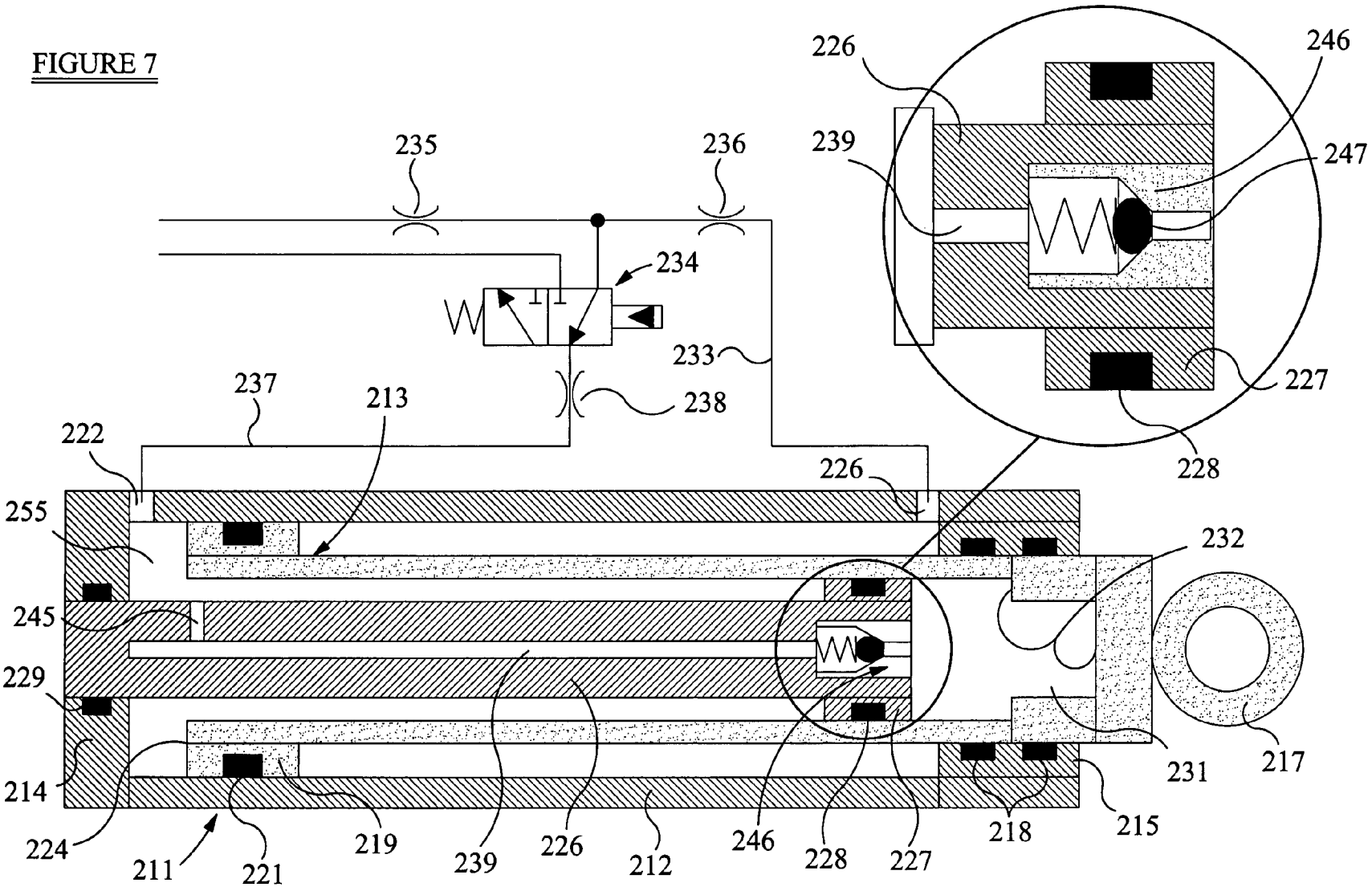

FIG. 5 a diagrammatic representation of a linear hydraulic actuator connected for operation in an extending mode;

FIG. 6 is a view similar to FIG. 5 but showing connections to the actuator for operation in a retraction mode; and FIG. 7 is a view similar to FIG. 5 of a modification.

Figure 1:
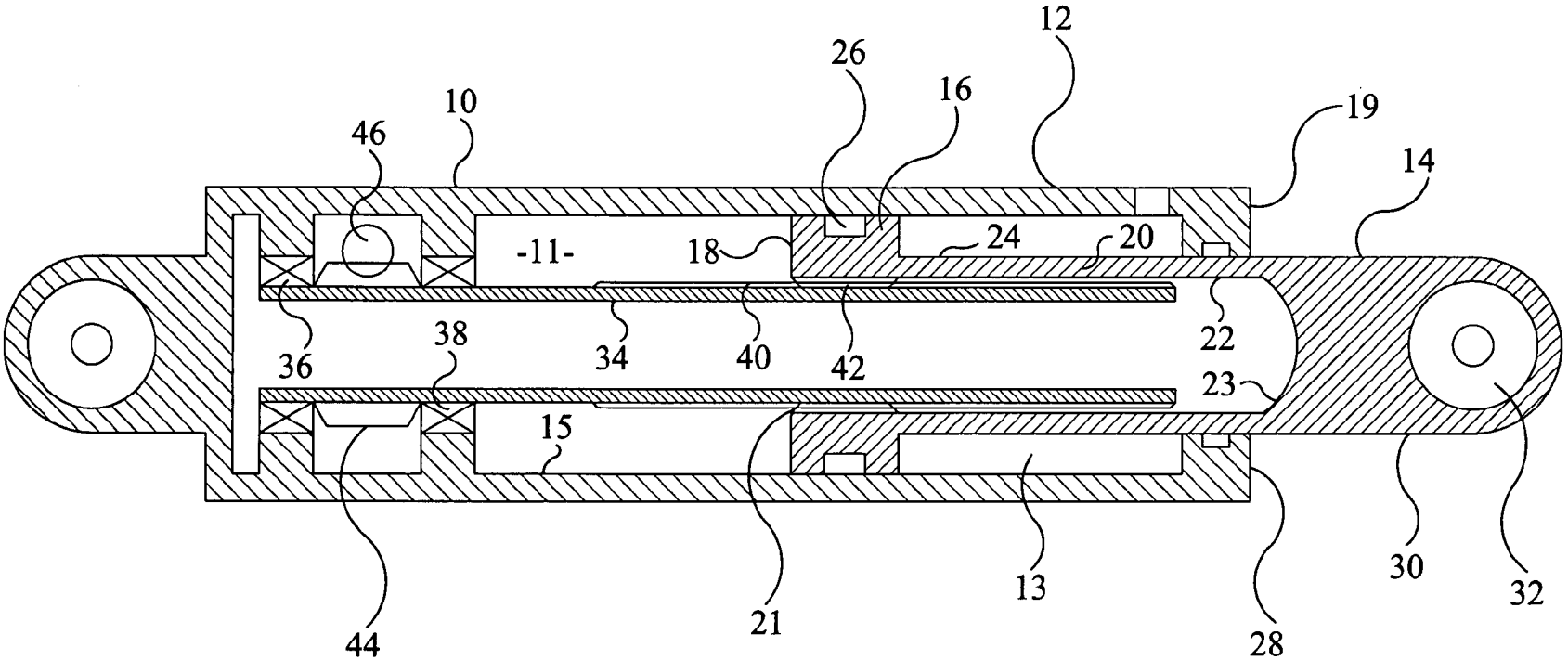
FIG. 1 shows a known linear hydraulic actuator that is used in an aircraft thrust reverser actuation system.

Referring to FIG. 1, a linear hydraulic actuator has a body 10, which defines a cylinder 12 having an inner cylindrical surface 15. A piston 14 having a large diameter cylindrical section 16 fits within the cylinder 12 and is separated from the inner cylindrical surface 15 by a first slidable circumferential seal 26. The piston 14 divides the space inside the cylinder 12 into a first chamber 11 and a second chamber 13.

The piston 14 also has a tubular section 20 that extends through an end wall 19 of the housing 10. A second slidable seal 28 is provided between the end wall and the tubular section 20. Thus, the piston 14 has an inboard end having an annular surface 18, and an outboard end 32 for coupling to a thrust reverser cowl. The tubular section 20 of the piston 14 has an open inboard end 21 within the cylinder, a bore 22 and a closed outboard end 23. The effective thrust surface of the piston exposed to the fluid pressure within the first chamber 11 is the full cross-sectional area of the cylinder.

A rotatable tube 34 is mounted in a pair of bearings 36, 38 and extends axially inside the cylinder 12 and into the open end 21 of the tubular section 20 of the piston 14. The rotatable tube 34 carries a coarse-pitch male thread 40, which engages a corresponding female thread 42 on a section of the bore 22 of the tubular section 20. A mechanical linkage 46 engages teeth 44 formed on the rotatable tube 34 between the bearings 36, 38. The linkage 46 extends from the actuator 10 to engage a corresponding rotatable tube in a second identical actuator.

In use, when hydraulic fluid under pressure is introduced into the cylinder 12 in the first chamber 11, the fluid pressure exerts a force against the piston 14 causing it to move (to the right as shown in FIG. 1) for operation of the thrust reverser member. As the piston 14 moves, the volume of the space to be filled with hydraulic fluid expands. This space includes not only the swept volume of the annular surface 18 in the region surrounding the rotatable tube 34, but also includes the volume of the space inside the bore 22 of the piston 14. A substantial quantity of hydraulic fluid must thus be pumped under pressure into the actuator 10 in order to cause operation thereof within the required operating time.

Movement of the piston 14 causes rotation of the rotatable tube 34 by way of the threaded engagement between the male thread 40 and the female thread 42. Rotation of the rotatable tube 34 activates movement of the linkage 46. The linkage 46 ensures that movement of the piston of the second actuator is synchronised with (i.e. identical to) the movement of the piston 16. This ensures that the thrust reverser is actuated with an equal movement at two (or more) points of actuation so as to prevent distortion of the thrust reverser member.

The piston is retracted back into the cylinder by removing the source of pressurised hydraulic fluid to the first chamber 11 and by introducing pressurised fluid only into the second chamber 13.

Figure 2:
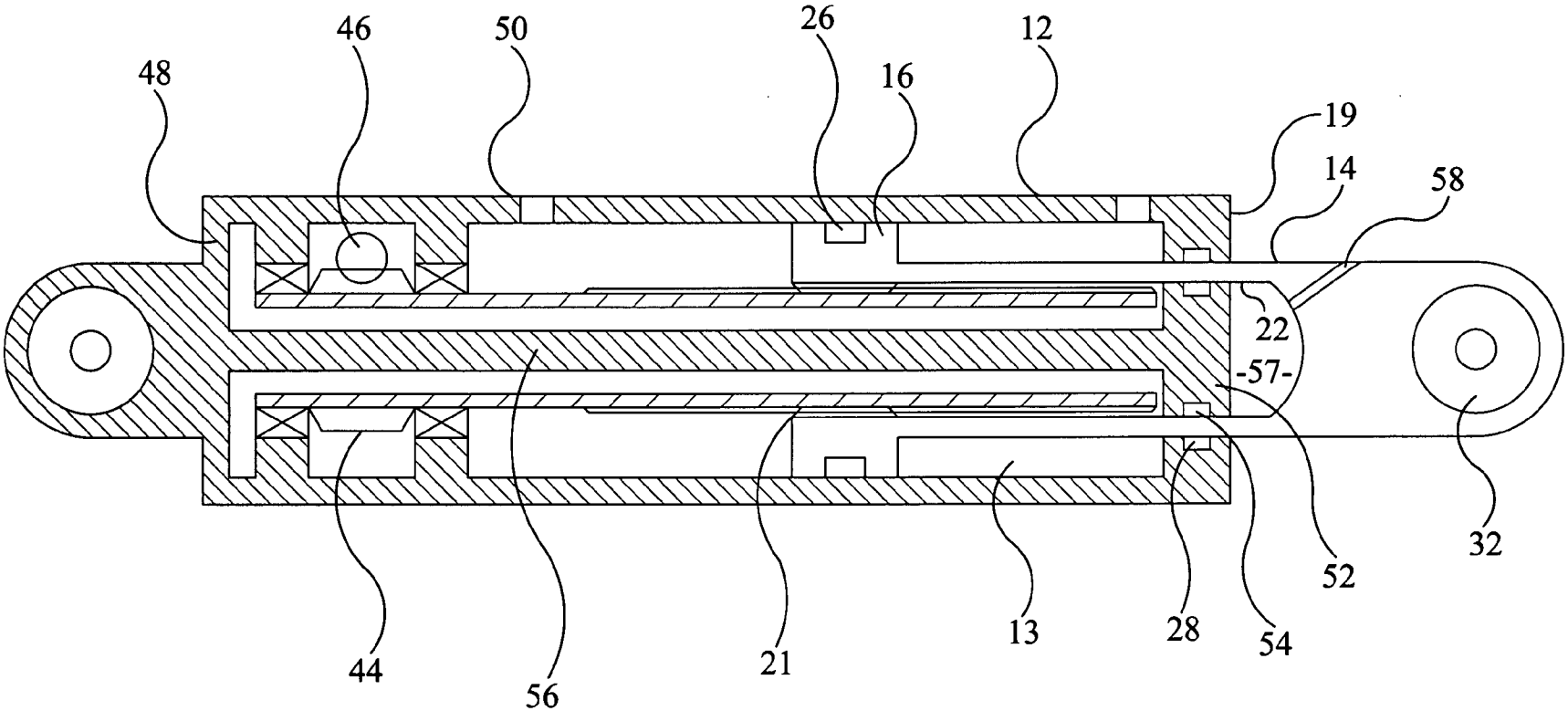
FIG. 2 shows a linear hydraulic actuator in accordance with an embodiment of the invention for use in a similar application to the actuator of FIG. 1.

Referring to FIG. 2, equivalent features are provided with equivalent reference numerals to those used for the actuator of FIG. 1. An actuator 50 is provided with a seal member 52 disposed internally of the tubular piston 14. The seal member 52 has a circumferential seal 54, which forms a slidable seal against the bore 22 of the piston 14. An axially extending stem 56 extends from the seal member 52 to an opposing end 48 of the actuator 50. The seal member 52 divides the space inside the bore 22 of the piston 14 so as to provide an outboard chamber 57. An opening 58 is provided through the piston 14 so that the outboard chamber 57 is open to the surrounding atmospheric pressure.

In use, as with the actuator of FIG. 1, when hydraulic fluid under pressure is introduced into the cylinder 12 in the first chamber 11, the fluid pressure exerts a force against the annular surface 18 of the piston 14 to move it (to the right as shown in FIG. 2) for operation of the thrust reverser cowl. The piston 14 slides past the second slidable seal 28 and the circumferential seal 54 on the seal member 52. Unlike the actuator of FIG. 1, the volume of the chamber 11 expands only by the swept volume of the annular surface 18, on movement of the actuator. The volume of pressurised hydraulic fluid within that part of the bore 22 of the piston 14 to the left of the seal member 52 (in the orientation illustrated) decreases as the piston extends to the right (as shown in FIG. 2) because the seal member 52 remains fixed while the piston moves past it. Thus a reduced quantity of hydraulic fluid is required to operate the actuator 50, when compared with the actuator 10 of FIG. 1. Consequently, for a given rate of high pressure supply, the time required to operate the actuator is reduced.

Retraction of the piston 14, and operation of the synchronisation mechanism occurs in the same way as for the actuator of FIG. 1. However, it should be borne in mind that the principles of the present invention are not restricted to the application of thrust reverser actuators, but apply equally to any linear hydraulic actuator that employs a tubular piston construction. It is also apparent that the actuator need not be provided with a second hydraulic chamber 13 for retracting the piston. Instead, retraction may be effected by removing the pressure of hydraulic fluid from the first chamber 11 and allowing external forces to push the piston 14 back into the cylinder 12.

Figure 3:
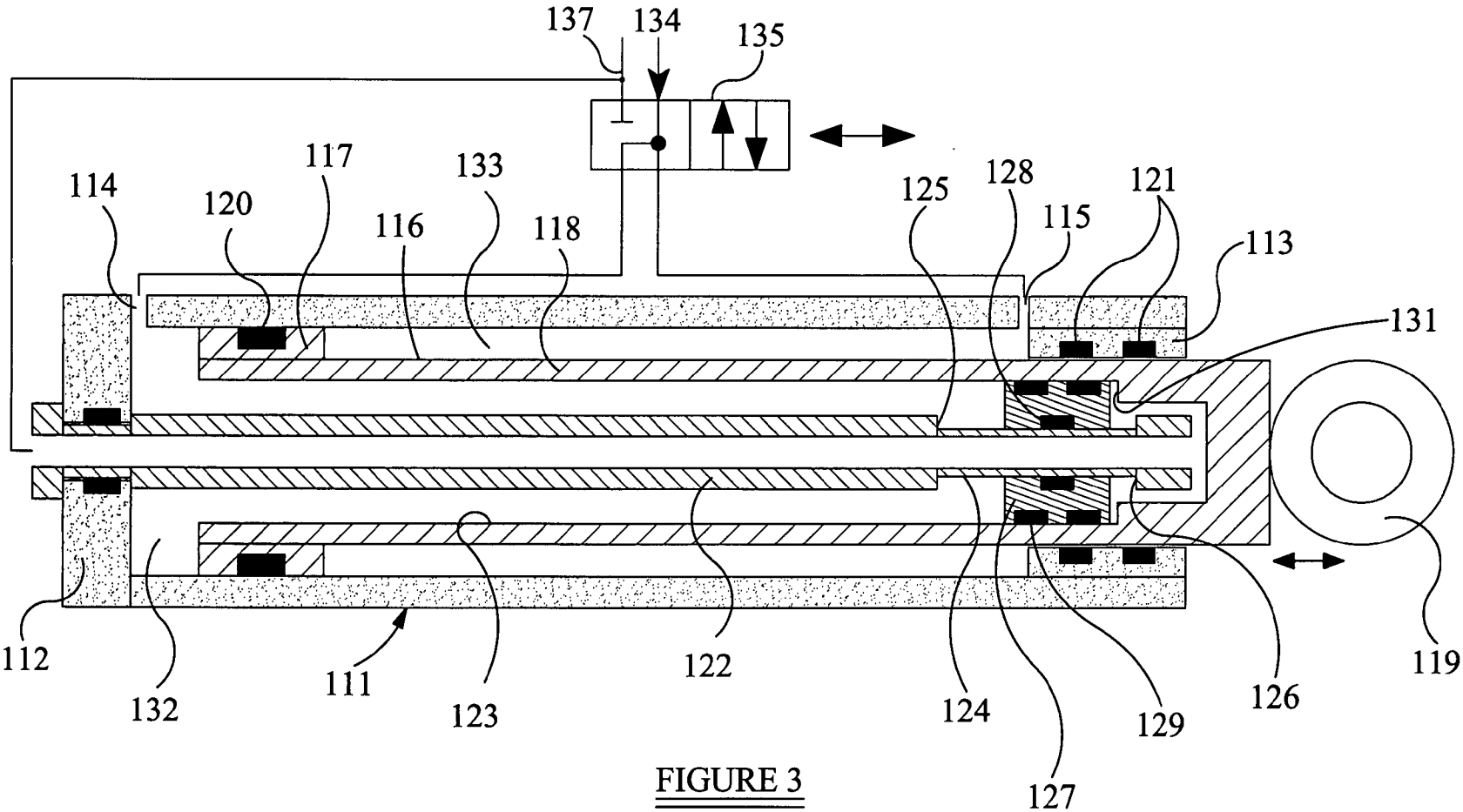
FIG. 3 is a diagrammatic cross-sectional representation of an hydraulically operable linear actuator in accordance with another example of the present invention.

Referring next to FIG. 3 there is illustrated a linear actuator including an elongate hydraulic cylinder 111 of circular cross-section, the cylinder 111 including opposite axial end closure members 112, 113. Adjacent each closure member 112, 113 the wall of the cylinder 111 includes a respective port 114, 115 through which hydraulic fluid can flow into and out of the cylinder.

Slidably received within the cylinder 111 is an elongate piston 116 including an annular piston head 117 and integral therewith, or rigidly secured thereto, a hollow elongate piston rod 118. The external diameter of the piston head 117 and the internal diameter of the cylinder 111 are such that the piston head 117 is a close sliding fit within the cylinder, and the piston head 117 includes an annular external sealing ring 120, sealing the sliding interface of the piston 116 and cylinder 111. The piston rod 118 is of elongate rectilinear form and is disposed with its longitudinal axis coincident with the longitudinal axis of the cylinder 111. The piston rod 118 is smaller in diameter than the internal diameter of the cylinder and so an annular clearance exists between the piston rod 118 and the inner wall of the cylinder 111. The cylinder end closure member 113 is annular, and the piston rod 118 extends within the cylinder 111, and protrudes through the central aperture of the closure member 113 for mechanical connection to the movable cowl assembly of an associated gas turbine engine thrust reverser system. Conveniently the free, outer end of the piston rod 118 has a universal ball connection indicated diagrammatically at 119. The surface of the central bore of the closure member 113 is formed with a pair of parallel circumferential grooves receiving sealing rings 121 which seal the sliding interface of the cylindrical outer surface of the piston rod 118 and the closure member 113. It will be appreciated that, as thus far described, the arrangement is very similar to that of FIG. 2.

Anchored to the closure member 112 and extending coaxially within the cylinder 111 and piston 116 is an elongate tubular element 122 of circular cross-section. The element 122 extends through the closure member 112 and so the central passage 123 of the tubular element 122 is accessible at the exterior of the closure member 112. The element 122 extends through the full axial length of the cylinder 111 and terminates within the piston rod 118 adjacent the outer end of the closure member 113. The free end region of the element 122 is formed with a neck region 124 of reduced external diameter, the neck region 124 being defined between opposed, spaced, radial shoulders 125, 126 of the element 122.

A seal member in the form of an annular supplementary piston 127 is slidably mounted on the neck region 124 of the element 122, and can slide relative to the element 122 between a rest position and a limit position defined respectively by the abutment of the respective ends of the piston 127 with the shoulders 125 and 126. An internal sealing ring 128 seals the sliding interface of the piston 127 and the neck region 124 of the element 122, and furthermore the piston 127 is in sliding engagement with the inner cylindrical surface of the hollow piston rod 118, the sliding interface of the supplementary piston 127 and the interior of the piston rod 118 being sealed by annular sealing rings 129. Internally, adjacent its outer end, the piston rod 118 is formed with a radially inwardly directed shoulder 131 against which one axial end of the supplementary piston 127 can abut in use.

The piston head 117 divides the interior of the cylinder 111 into first and second chambers 132, 133. The actuator has a rest position in which the piston 116 is retracted within the cylinder 111. In order to extend the piston hydraulic fluid under pressure is admitted to the cylinder 132 to displace the piston 116 to the right of the position shown in FIG. 3 to increase the amount by which the piston protrudes from the closure member 113. The actuator has an actuated position (not shown) in which the piston head 117 is close to, or actually abuts, the inner face of the cylinder closure member 113.

It should be recognised that the relative positions of the main piston 116 and supplementary piston 127, which are depicted in FIG. 3, will not normally exist in practice, and with the main piston 116 in its retracted, rest position the right-hand end of the supplementary piston 127 would normally abut the shoulder 131 of the piston rod 118.

Assuming therefore that the supplementary piston 127 is abutting the shoulder 131, then the application of hydraulic fluid under pressure to the chamber 132 through the port 114 exposes the left-hand end face of the piston head 117, the left-hand end face of the piston rod 118, and the left-hand end face of the supplementary piston 127 to hydraulic fluid under pressure, thus driving the main piston 116 to the right, to extend the piston. The force generated is of course a function of the hydraulic pressure difference across the assembly of pistons, and the area of the pistons exposed to the pressure.

The piston 116 and the piston 127 will continue to move to the right as a unit until the supplementary piston 127 abuts the shoulder 126 of the element 122, arresting the piston 127 against further axial movement to the right relative to the element 122 and the cylinder 111. Although hydraulic pressure still acts against the left-hand face of the supplementary piston 127 this is of no effect since the supplementary piston 127 cannot move any further to the right. However the left-hand face of the piston head 117 and piston rod 118 continue to be subjected to hydraulic pressure and the piston 116 thus continues to move, sliding relative to the now arrested supplementary piston 127. It will be recognised that because the exposed surface area of the supplementary piston 127 is no longer assisting the movement of the piston 116 then the force generated by the actuator is reduced, without changing the pressure of the hydraulic fluid, immediately the supplementary piston 127 is arrested. After the supplementary piston 127 contacts the shoulder 126, further extension of the piston 116 will require a smaller volume of hydraulic fluid to be supplied to the chamber 132 per unit of extension than when the movement of the piston 116 was assisted by the supplementary piston 127.

FIG. 3 shows that there is a relatively small distance through which the piston 127 can move with the piston rod 118 before abutting the shoulder 126 of the element. 122. In practice of course this distance will be set in accordance with the length of the stroke of the piston 116 over which the assistance of the supplementary piston 127 is required. This in turn will be determined by the nature of the mechanism being actuated by the actuator.

FIG. 3 shows a convenient hydraulic circuit for the actuator. It can be seen that hydraulic fluid under pressure is supplied from a high pressure source 134 through a changeover valve 135. The valve 135 also has a connection to low pressure 137 which is also connected to the interior of the right hand end region of the piston rod 118 through the passage 123 of the element 122. In a first, actuation position of the valve 135 hydraulic fluid under pressure is supplied simultaneously to both port 114 and port 115, and so the same hydraulic pressure is applied to both opposite exposed faces of the piston head 117. The effect of supplying the same hydraulic fluid pressure to both chamber 132 and chamber 133 is to negate the effect on the piston 116 of the surface area of the piston head 117. Nevertheless, the piston 116 will still be moved to the right since the hydraulic pressure in the chamber 132 is applied also to the end face of the piston rod 118, and also, during initial movement from the rest position, to the supplementary piston 127.

Even when the supplementary piston 127 is arrested the piston 116 is still biased to the right by the effect of the hydraulic pressure on the end surface area of the piston rod 118. It can be seen that the ports 114, 115 are actually interconnected through the valve 135, and thus hydraulic fluid displaced from the chamber 133 by movement of the piston 116 to the right flows to the chamber 132 through the port 114 minimising the volume of hydraulic fluid which needs to be supplied from the source 134 to operate the actuator. Moreover as the main piston 116 moves relative to the arrested supplementary piston 127 the increasing volume of the void in the piston rod 118 to the right of the piston 127 is filled by low pressure hydraulic fluid drawn into the void through the passage 123.

When it is necessary to retract the piston 116 from its actuated position back towards its rest position, the valve 135 is moved to its second position in which hydraulic fluid under pressure from the source 134 is applied only to the chamber 133 through the port 115, and the port 114 and chamber 132 are connected to the low pressure return 137 through the valve 135. Thus when retracting the piston 116 hydraulic fluid under pressure is applied only to the right-hand face of the piston head 117, and low pressure fluid from the interior of the piston rod 118 to the right of the piston 127 is displaced as the piston rod 118 slides relative to the piston 127, through the passage 123 of the element 122 to the low pressure return 137.

When the actuator of FIG. 3 is used to operate a thrust reverser system of an aircraft gas turbine engine there is sufficient force generated by the actuator, in the initial movement of the actuator from its rest position, to start the deployment of the thrust reverser cowls against the air/gas flow resistance mentioned above. However, at a point at which this resistance ceases, and the air/gas flow starts to assist deployment of the cowls, the piston 127 will have been arrested by the shoulder 126 of the element 122 and thereafter the actuator will apply only relatively small loading to the cowls in the deployment direction. During this phase of the movement the primary purpose of the actuator is to control the movement of the cowls and not necessarily to drive them to their deployed position since the driving force necessary to achieve deployment may well be derived from the air/gas flow around the cowls. However, it will be recognised that if the cowls need to be deployed while the aeroplane is stationary, with the engine not operating, for example for servicing, then there will be sufficient force generated by the actuator, throughout the whole stroke of the actuator, to move the cowls from their stowed to their deployed positions and back again.

Should there be any leakage of hydraulic fluid past the seals 128, 129 of the supplementary piston 127, then such leakage will collect in the closed end of the piston rod 118 and will be returned to low pressure 137 through the central passage 123 of the element 122.

Figure 4:
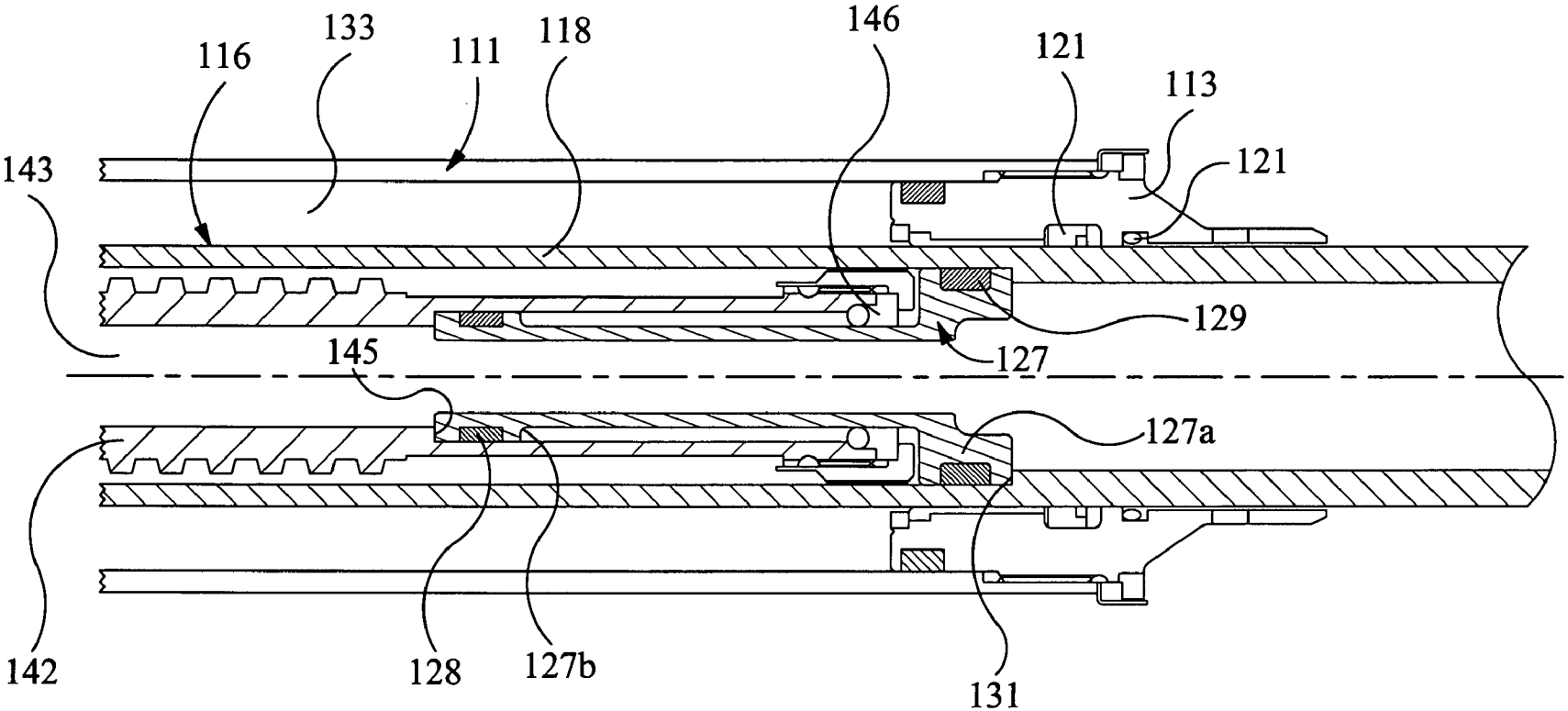
FIG. 4 is a view similar to FIG. 3 of part of an hydraulically operable linear actuator in accordance with another example of the present invention.

Turning now to the alternative construction illustrated in FIG. 4, parts common to FIG. 3 carry the same reference numerals. Moreover, although the piston 116 includes a piston head and piston rod 118 equivalent to those of FIG. 3, the piston head of the piston 116 of FIG. 3 is not visible in FIG. 4, because FIG. 4 is a view of only part of the actuator. The actuator illustrated in FIG. 4 differs from the actuator described above with reference to FIG. 3 primarily in that the actuator of FIG. 4 incorporates a hollow rotatable synchronising shaft 142 having a central passage 143 extending therethrough. As described hereinbefore, it is known in other linear actuators to incorporate an axially fixed, but rotatable synchronising shaft which is rotated through the intermediary of a screw mechanism as the piston 116 moves axially relative to the cylinder 111. The thrust reverser system of a gas turbine engine may utilise a plurality of actuators to operate the cowls, and of course it is desirable for the actuators to move in synchronism so that the cowls are not subjected to unbalanced, or twisting loads. In use the synchronising shafts of the actuators of one or more cowls can be interconnected by a shaft arrangement so that the pistons of the actuators are constrained to move in unison.

The inventor has recognised that the presence of a synchronising shaft 142 in the actuator shown in FIG. 4 removes the need to provide the element 122 described above in relation to FIG. 3 since the synchronising shaft 142, although rotatable, is axially fixed and can thus be used to support the supplementary piston 127. In FIG. 4 it can be seen that the hollow synchronising shaft 142 is adapted at its end remote from the cylinder closure member 112 to slidably receive within it a supplementary piston 127. The supplementary piston 127 protrudes from the interior of the shaft 142 at the free end of the shaft 142 and includes a piston head 127*a* slidably received within the piston rod 118 of the main piston 116. An annular seal 129 seals the sliding interface of the supplementary piston 127 and the interior of the piston rod 118, and the piston rod 118 includes an internal, radially inwardly extending shoulder 131, against which the right-hand end of the head 127*a* of the piston 127 can abut.

The supplementary piston 127 extends into the shaft 142 and is slidably received therein. The left-hand end of the supplementary piston 127 within the shaft 142 can abut a radially inwardly extending shoulder 145 provided in the shaft 142 to define the axial rest position of the supplementary piston 127 relative to the shaft 142 and the cylinder 111. An annular sealing ring 128 seals the sliding interface of the left-hand end of the supplementary piston 127 and the interior of the shaft 142. Adjacent its left-hand end the supplementary piston 127 includes a radially outwardly extending shoulder 127*b* which can abut a thrust bearing assembly 146 carried at the free end of the shaft 142. The thrust bearing assembly 146 is secured to the free end of the shaft 142 and extends radially inwardly to surround the supplementary piston 127 between the piston head 127*a* and the shoulder 127*b*. Abutment of the shoulder 127*b* with the bearing assembly 146 defines the limit position of the supplementary piston 127 relative to the shaft 142 and cylinder 111. The thrust bearing assembly 146 can take a number of forms, but conveniently includes a plurality of rotatable balls which ride on the outer surface of the piston 127 during axial movement of the piston 127 relative to the shaft 142, and which abut the shoulder 127*b* in the limit position of the piston 127. It will be understood that during axial translation of the piston 116 relative to the cylinder 111 the shaft 142 is being rotated within the piston rod 118. As the piston head 127*a* is, during the initial part of the movement of the piston 116, bearing against the shoulder 131 of the piston rod 118 then the piston 127 will be moving axially with the piston 116, but will not be rotating with the shaft 142. Thus when the piston 127 reaches its limit position with shoulder 127*b* abutting the bearing 146 the bearing 146 will facilitate rotation of the shaft 142 about the piston 127 so that the piston 127 is not caused to rotate in the piston rod 118.

The operation of the actuator illustrated in FIG. 4 is substantially identical to that described above in relation to FIG. 3. When the actuator is in its rest position the head 127*a* of the supplementary piston 127 abuts the shoulder 131 of the piston rod 118 and the supplementary piston 127 is in a rest position relative to the cylinder 111, said rest position conveniently being defined by abutment of the left-hand end of the supplementary piston 127 with the shoulder 145 of the shaft 142. Application of hydraulic fluid under pressure to the chamber 132 of the actuator applies hydraulic pressure to the piston head, the piston shaft 118, and the left-hand face of the piston head 127*a* of the supplementary piston 127. Thus the supplementary piston 127 moves to the right with the piston 116, providing part of the driving force for moving the piston 116. The piston 116 moves to the right, that is to say in an actuation direction, at least in part under the influence of the piston 127 until the piston 127 reaches its limit position defined by abutment of the shoulder 127*b* with the thrust bearing 146. Thereafter the piston 116 continues to move to the right sliding relative to the piston 127. As the shaft 142 of the FIG. 4 arrangement is hollow, the passage 143 of the shaft 142 can provide a low pressure return for hydraulic fluid leaking past the seal 129 of the piston 127 and for hydraulic fluid drawn into and expelled from the piston rod 118 as it moves relative to the piston 127.

In both the FIG. 3 and FIG. 4 actuators it will be appreciated that during retraction movement of the piston 116 there is a point at which the shoulder 131 of the piston rod 118 abuts the supplementary piston 127 which, at this time, is still in its limit position. Thereafter the supplementary piston is returned to its rest position by the retraction movement of the piston 116 to its rest position. As mentioned above the rest position of the piston 127 of FIG. 4 is conveniently defined by abutment of the left-hand end of the piston 127 with the shoulder 145 in the shaft 142. Similarly, in FIG. 3 the rest position of the supplementary piston 127 is conveniently defined by abutment of the left-hand end of the piston 127 with the shoulder 125 on the element 122. It is to be understood however that it is not essential that the rest positions of the pistons 127 are defined by abutment, since the pistons 127 will be carried back to a rest position by the respective piston 116 during retraction.

Referring next to FIGS. 5 and 6 of the drawings, the linear hydraulic actuator 211 includes an elongate hydraulic cylinder 212 of circular cross-section and an elongate piston assembly 213 also of circular cross-section slidably received within the cylinder 212 and coaxial therewith.

The cylinder 212 is closed at one end by an end cap 214 and closed at its opposite end by an annular bush 215 through which an elongate hollow piston rod 216 of the piston assembly 213 extends. At its outermost end the piston rod 216 is provided with a coupling 217 whereby in use the piston rod is connected to a component to be moved by the actuator, for example a movable cowl of an aircraft gas turbine engine thrust reverser arrangement. Seal rings 218 carried by the bush 215 seal the sliding interface of the bush 215 and the piston rod 216.

At its end within the cylinder 212 the piston rod 216 carries an annular piston head 219 of the piston assembly 213. The outer diameter of the piston rod 216 is less than the inner diameter of the cylinder 212 and at the innermost end of the piston rod 213 the annular clearance between the rod 216 and the cylinder wall is occupied by the annular piston head 219, a seal ring 221 carried by the piston head 219 serving to seal the sliding interface of the piston assembly 213 in the cylinder 212.

Adjacent the end cap 214 the wall of the cylinder 212 is formed with an inlet union 222 through which hydraulic fluid under pressure can be admitted to a pressure chamber 225 defined at one end of the cylinder between the end cap 214 and the annular end face of the piston assembly 213. Adjacent the bush 215 the wall of the cylinder 212 is formed with an outlet union 223 through which hydraulic fluid can flow to and from the annular clearance between the piston assembly 213 and the cylinder 212.

Extending coaxially within the cylinder 211, from the end cap 214, is an elongate rod 226. The rod 226 is anchored to the end cap 214 and extends within the hollow piston rod 216 of the piston assembly 213. At its free end, remote from the end cap 214 and adjacent the bush 215, the rod 226 carries a seal member in the form of an external collar 227 slidably engaging the interior surface of the piston rod 216, a seal ring 228 sealing the sliding interface of the collar 227 and piston rod 216. A seal ring 229 seals the region of engagement of the rod 226 with the end cap 214. It will be recognised that the rod 226, collar 227, and seal ring 228 isolate an inner, end chamber 231 defined within the piston rod 216 from the pressure chamber 225 of the cylinder 212. Thus hydraulic fluid under pressure admitted to the chamber 225 through the union 222 acts upon the annular end face 224 of the piston assembly, but does not act upon the inner opposite end surface 232 of the piston assembly.

It will be appreciated that the arrangement of FIG. 5 is very similar to that of FIG. 2, except that the chamber 231 is not vented directly to the atmosphere.

In FIG. 5 the actuator is shown with the piston assembly in a retracted position, and about to be operated to displace the piston assembly 213 to the right in FIG. 5. The hydraulic fluid pressure system associated with the actuator 211 includes a first fluid line, identified in the drawings as HP, connected to the output of a pump (not shown) for supplying high pressure (HP) hydraulic fluid. A second fluid line, indicated in the drawings as LP is the low pressure return line of the system, and may be connected to an hydraulic fluid reservoir. The HP line is connected through first and second restrictors 235, 236 in series to a line 233 in turn connected to the port 223 of the cylinder 212. The LP line, and a tapping intermediate the restrictors 235, 236 are connected to a change-over valve 234 and a supply line 237 from the valve 234 is connected to the port 222. When it is desired to extend the actuator from its retracted position the change-over valve 234 is moved to the position shown in FIG. 5 in which the tapping intermediate the restrictors 235 and 236 of the HP line is connected through a further restrictor 238 to the supply line 237. It will be recognised that in this position of the change-over valve 234 both the pressure chamber 225, and the annular chamber defined between the piston rod 216 and the inner wall of the cylinder 212 are exposed to hydraulic fluid under high pressure from the HP line. However, the area of the piston assembly 213 exposed to HP in the chamber 225 exceeds the area exposed to HP in the annular gap between the piston rod 216 and the cylinder 212 by the thickness of the piston rod 216, and thus there is a force on the piston assembly 213 tending to displace the assembly to the right in the drawings.

The elongate rod 226 is formed with a through passage or conduit 239 communicating with the chamber 231 within the piston rod 216. At its end remote from the chamber 231 the conduit 239 communicates with a line 241 which is connected to the line 237 through a restrictor 242. Thus not only is the chamber 225 supplied with hydraulic fluid at high pressure, but also the chamber 231 is supplied with hydraulic fluid at high pressure. However, in normal operation, the speed at which the piston assembly 213 is moved under the action of pressurised hydraulic fluid admitted to the chamber 225 and thus the rate at which the volume of the chamber 231 increases, is greater than the rate at which hydraulic fluid can be supplied through the restrictor 242 to the chamber 231. During normal operation therefore fluid supplied to the chamber 231 through the restrictor 232 and conduit 239 does not provide a driving force on the piston assembly 213, and, cavitation will occur in the fluid within the chamber 231 as the volume of the chamber 231 increases at a rate greater than that at which fluid is supplied through the restrictor 242.

In the event that the actuator is required to drive a load which exceeds that which can be moved by the hydraulic pressure applied to the surface 224 of the piston assembly 213 then the actuator will stall, that is to say the piston assembly will fail to move, or will cease to move. In such circumstances the volume of the chamber 231 will not be increasing, and so the pressure applied to the chamber 231 will increase as fluid continues to flow through the restrictor 242, climbing towards the pressure in the chamber 225, so that pressure acting on the internal surface 232 of the piston rod 216 will assist pressure acting on the surface 224 of the piston assembly providing the piston with a much increased effective area and allowing the actuator to generate sufficient force to overcome the load causing the actuator to stall. Immediately the load has been overcome, and the force required of the actuator falls, then the speed of movement of the piston assembly 213 will increase, and the surface 232 will cease to be effective as the rate of supply of fluid to the chamber 231 through the restrictor 242 will be less than the rate at which the volume of the chamber 231 is increasing, and again cavitation in the chamber 231 will occur.

It will be understood from the foregoing description that the actuator normally provides an output force determined by the pressure in the chamber 225 acting on the surface 224 of the piston assembly, but in a stall condition the pressure in the chamber 231 increases allowing the surface 232 to augment the surface 224 and thus to provide the actuator with an increased output force.

If, in operation, it appears that cavitation within the chamber 231 is problematic, then the line 241 can also be connected to the LP line so that the LP line provides top-up fluid to the chamber 231 to prevent cavitation. The connection between the line 241 and the LP line will of course include a non-return valve so that fluid cannot flow from the line 241 to the LP line.

It will be recognised that during extension movement of the piston assembly 213 fluid is displaced from the annular gap between the piston rod 216 and the inner surface of the cylinder 212. This fluid is displaced back along the line 233 through the restrictor 236 and augments the volume of fluid flowing through the restrictor 235 and the valve 234 to the port 222.

FIG. 6 illustrates the position of the valve 234 during retraction movement of the actuator, when the piston assembly 213 is being driven to the left. It can be seen that the HP line is still connected through the restrictors 235 and 236 and the line 233 to the port 223, but the line 237 is now connected to the LP line. Thus high pressure fluid acting on the head 219 of the piston within the annular gap between the piston rod and the cylinder pushes the piston assembly 213 to the left and hydraulic fluid displaced from the chamber 225 flows from the port 222, through the line 237 and the change-over valve 234 to the LP line. At the same time hydraulic fluid displaced from the chamber 231 by the reduction in the volume of the chamber 231 accompanying leftward movement of the piston assembly flows through the line 241 and a non-return valve 243 in parallel with the restrictor 242, to the line 237. The positioning of the non-return valve 243 is such that it opens to allow flow from the chamber 231 back to the line 237 without the fluid being forced to flow through the restrictor 242, but closes during extension of the actuator so that fluid from the line 237 to the chamber 231 must flow through the restrictor 242.

It is believed that in practice it may be possible to combine the restrictor 242 and the check valve 243 into a single component which can be considered to be a "leaky" non-return valve. Thus, the "leaky" non-return valve would be such that during extension movement of the actuator there is a leakage flow through the non-return valve which thus constitutes a restrictor, but during retraction movement the check valve will open so that there is little or no restriction upon the return flow from the chamber 231.

The modified actuator illustrated in FIG. 7 embodies a so-called "leaky" non-return valve. In FIG. 7 components of the actuator common to FIGS. 5 and 6 carry the same reference numerals. The most significant difference between the actuator of FIGS. 5 and 6 and the modified actuator of FIG. 7, is that the conduit 239 in the rod 226 of the FIG. 7 actuator is connected through a radial drilling 245 in the rod 226, to the pressure chamber 225 of the actuator and in place of the external parallel arrangement of restrictor 242 and non-return valve 243 there is provided a combined restrictor and non-return valve 246 housed within the inner end of the rod 226 and providing a flow path between the conduit 239 and the end chamber 231 of the actuator.

The combined restrictor and non-return valve 246 is a "leaky" non-return valve, typically a ball-valve (as shown in FIG. 7) or a poppet-valve. The valve is "leaky" in that there is a restricted, leakage path for fluid flow from the conduit 239 into the chamber 231 between the spring pressed ball or the poppet of the valve and its associated valve seating. Thus in the closed position of the valve 246 the valve defines the equivalent of the restrictor 242 of FIGS. 5 and 6. However, during retraction movement of the piston assembly 213 of the actuator the valve 246 acts in the same manner as the valve 243 shown in FIGS. 5 and 6, the ball 247 being lifted away from its seating, against the action of its closure spring, to permit a relatively unrestricted flow of hydraulic fluid from the chamber 231, through the conduit 239 and the radial drilling 245 into the chamber 225, so as to flow with the fluid being expelled from the chamber 225 through the line 237.

It will be recognised therefore that the operation of the actuator illustrated in FIG. 7 is substantially identical to that described above with reference to FIGS. 5 and 6.

In the embodiments described herein reference is made to flow restrictors 235, 236 and 238. An understanding of the function of the restrictors is not of importance to the present invention, and it is sufficient to recognise that the restrictors are sized in relation to one another to control the speed of actuation of the actuator and to minimise cavitation during retraction movement of the actuator, and also in deployment movement of the actuator where deployment may be assisted by, for example, reversal of the axial loading imposed on the piston assembly.

If desired, the embodiments of FIGS. 5 to 7 may be modified to incorporate a synchronisation mechanism, for example of the general type described hereinbefore. It may also be possible to replace the axially fixed seal member with a movable seal member, for example of the supplementary piston type described with reference to FIG. 3 or FIG. 4.

It will be appreciated that a range of modifications and alterations to the arrangements described hereinbefore without departing from the scope of the invention.

We claim:

1. A linear hydraulic actuator comprising a hollow main piston axially moveable, through a range of movement, between a rest position and an actuated position, in an elongate cylinder under the influence of hydraulic pressure, the main piston defining a bore within which a seal member is provided, the seal member forming a sliding seal with the bore of the main piston wherein the seal member comprises a supplementary piston slidably received within said main piston and movable longitudinally relative to said cylinder between a rest position and a limit position, said supplementary piston and said main piston including respective abutment surfaces which co-act when both the main piston and the supplementary piston are in their respective rest positions and hydraulic pressure is applied to said supplementary piston to move it from its rest position towards its limit position, the abutment of said surfaces of said supplementary piston and said main piston being such that during movement of the supplementary piston from its rest position towards its limit position said supplementary piston pushes the main piston in its movement from its rest position towards its actuated position.

2. An actuator according to claim 1, wherein movement of said supplementary piston is arrested at its limit position whereafter said main piston can continue to move relative to said cylinder towards its actuated position sliding relative to said supplementary piston.

3. An actuator according to claim 2, wherein said supplementary piston is slidably supported on an elongate element axially fixed with respect to said cylinder, and said element and said supplementary piston include an abutment surface defining said limit position of said supplementary piston.

4. An actuator according to claim 3, wherein said elongate element is hollow, and provides a communication path whereby hydraulic fluid entering the elongate element in use can return to a low pressure side of an associated hydraulic system.

5. An actuator according to claim 1, wherein the co-operation of said main piston with said cylinder defines, within said cylinder, first and second chambers on opposite sides respectively of said main piston, said main piston exposing a larger surface area to said first chamber than to said second chamber so that application of the same hydraulic pressure to both chambers urges the main piston to move in a direction relative to said cylinder to reduce the volume of said second chamber.

6. An actuator according to claim 1, wherein the seal member and bore of the main piston together define a closed chamber, and a fluid flow path is provided between said closed chamber of said main piston and a hydraulic fluid supply line, said fluid flow path including a flow restrictor whereby the rate at which hydraulic fluid can enter said closed chamber of said main piston from said supply line is less than the rate at which the volume of said closed chamber increases as said piston is moved over at least part of the range of movement of the main piston.

7. An actuator according to claim 6, wherein a non-return valve is associated with said fluid flow path so that during movement of said piston relative to said cylinder to discharge hydraulic fluid from the closed chamber through said fluid flow path, said valve opens so that fluid discharged from the closed chamber is not required to flow through said restrictor.

8. An actuator according to claim 7, wherein said seal member is carried by a rod disposed coaxially within said hollow piston and secured to the cylinder.

9. An actuator according to claim 8, wherein said fluid flow path includes a passage extending through said rod.

10. An actuator according to claim 8, wherein said non-return valve is carried by said rod.

11. An actuator according to claim 6, further comprising a change-over valve operable in a first position to connect the supply line to a supply of hydraulic fluid under pressure, and operable in a second position to connect said supply line to low pressure to permit discharge of hydraulic fluid from the actuator.

12. An actuator according to claim 7, wherein said restrictor and said non-return valve are connected hydraulically in parallel with one another.

13. An actuator according to claim 7, wherein said restrictor and said non-return valve are defined by a common component in the form of a non-return valve which leaks in its closed position to permit a restricted flow of hydraulic fluid from said supply line to said closed chamber.

14. An actuator according to claim 1, further comprising a synchronisation mechanism for synchronising movement of the main piston with movement of one or more pistons of one or more other actuators coupled to the synchronisation mechanism.

15. An actuator according to claim 14, wherein the synchronisation mechanism comprises a rotatable tube mounted axially within the cylinder and extending into the bore of the hollow main piston, wherein the rotatable member has a thread that engages a corresponding thread on the bore of the main piston such that movement of the main piston causes rotation of the tube.

* * * * *